US008641192B2

(12) United States Patent
Arrigotti et al.

(10) Patent No.: US 8,641,192 B2
(45) Date of Patent: Feb. 4, 2014

(54) SYSTEM AND METHOD FOR MANUFACTURING A LENS, SUCH AS AN OPHTHALMIC LENS

(75) Inventors: Stan Arrigotti, Portland, OR (US); Gordon Keane, Portland, OR (US)

(73) Assignee: Digital Vision, Inc., Portland, OR (US)

( * ) Notice: Subject to any disclaimer, the term of this patent is extended or adjusted under 35 U.S.C. 154(b) by 401 days.

(21) Appl. No.: 13/212,079

(22) Filed: Aug. 17, 2011

(65) Prior Publication Data

US 2011/0301740 A1 Dec. 8, 2011

Related U.S. Application Data

(62) Division of application No. 11/929,588, filed on Oct. 30, 2007, now Pat. No. 8,002,406.

(51) Int. Cl.
*G02C 3/00* (2006.01)

(52) U.S. Cl.
USPC ..... 351/159.73; 264/1.32

(58) Field of Classification Search
USPC ..... 351/159, 159.01, 159.72, 159.73, 351/159.74, 159.75, 159.76; 65/37; 264/1.32
See application file for complete search history.

(56) References Cited

U.S. PATENT DOCUMENTS

| | | | | |
|---|---|---|---|---|
| 4,185,897 | A | | 1/1980 | Frieder |
| 4,573,121 | A | | 2/1986 | Saigo et al. |
| 4,580,883 | A | | 4/1986 | Shinohara |
| 4,710,193 | A | | 12/1987 | Volk |
| 4,958,280 | A | | 9/1990 | Pauly et al. |
| 5,368,790 | A | * | 11/1994 | Greshes ..... 264/2.4 |
| 5,485,399 | A | | 1/1996 | Saigo et al. |
| 5,805,336 | A | * | 9/1998 | Dalzell et al. ..... 359/487.02 |
| 5,880,809 | A | | 3/1999 | Lieberman et al. |
| 5,983,201 | A | | 11/1999 | Fay |
| 6,019,470 | A | | 2/2000 | Mukaiyama et al. |
| 6,051,091 | A | * | 4/2000 | Wood et al. ..... 156/103 |
| 6,058,373 | A | | 5/2000 | Blinn et al. |
| 6,082,856 | A | | 7/2000 | Dunn et al. |
| 6,089,713 | A | | 7/2000 | Hof et al. |
| 6,508,553 | B2 | | 1/2003 | Gao et al. |
| 6,637,880 | B1 | | 10/2003 | Yamakaji et al. |
| 6,792,401 | B1 | | 9/2004 | Nigro et al. |
| 6,871,955 | B2 | | 3/2005 | Yamakaji et al. |
| 7,029,116 | B2 | | 4/2006 | Roscini |

(Continued)

FOREIGN PATENT DOCUMENTS

JP 2002133219 A 5/2002

OTHER PUBLICATIONS

"Announcing Sweep," Product brochure of Digital Vision, inc., www.thedvi.com (applicant herein), published before Aug. 10, 2010, 2 pgs.

(Continued)

*Primary Examiner* — James Greece
(74) *Attorney, Agent, or Firm* — Perkin Coie LLP

(57) ABSTRACT

A system and method for manufacturing an ophthalmic lens is described. In some examples, the system applies a back surface to a lens blank that includes an aspherical curve having two radii of curvature. In some examples, a back surface of a peripheral portion of the lens follows the curvature of a front surface of the lens in order to establish a rounded, non-sharp edge to a lens blank used during the manufacturing process of a prescription eyeglass lens.

21 Claims, 6 Drawing Sheets

(56) References Cited

U.S. PATENT DOCUMENTS

| | | | | |
|---|---|---|---|---|
| 7,051,209 | B1 | 5/2006 | Brickell | |
| 7,054,836 | B2 | 5/2006 | Christensen et al. | |
| 7,188,082 | B2 | 3/2007 | Keane et al. | |
| 7,784,937 | B2 | 8/2010 | Keane et al. | |
| 7,840,444 | B2 | 11/2010 | Mellon et al. | |
| 8,002,406 | B2 | 8/2011 | Arrigotti et al. | |
| 8,020,990 | B2 | 9/2011 | Keane et al. | |
| 2002/0118337 | A1 | 8/2002 | Perrott et al. | |
| 2002/0143653 | A1 | 10/2002 | DiLena et al. | |
| 2003/0086055 | A1 | 5/2003 | Morris et al. | |
| 2004/0075807 | A1 | 4/2004 | Ho et al. | |
| 2004/0246440 | A1 | 12/2004 | Andino et al. | |
| 2005/0021137 | A1 | 1/2005 | Blake et al. | |
| 2005/0204881 | A1* | 9/2005 | Chen | 83/13 |
| 2005/0206834 | A1* | 9/2005 | D'Agostino | 351/41 |
| 2005/0206840 | A1 | 9/2005 | Roscini | |
| 2006/0098161 | A1 | 5/2006 | Dumange et al. | |
| 2009/0048670 | A1 | 2/2009 | Grierson et al. | |
| 2011/0153054 | A1 | 6/2011 | Hagen et al. | |
| 2011/0299031 | A1 | 12/2011 | Keane et al. | |
| 2011/0304816 | A1 | 12/2011 | Arrigotti et al. | |

OTHER PUBLICATIONS

"Aspheric Flat-Top 35," Product brochure of Bristol C & D, Inc., www.bcdlens.com, believed published before Aug. 10, 2010, 2 pgs.

"Bristolite Flat-Top," Product brochure of Bristol Consulting & Development, Inc., Miami, FL., believed published before Aug. 10, 2010, 2 pgs.

"Cosmolit Aspheric Plus Lenses," Product brochure of Rodenstock GMBH, believed published before Aug. 10, 2010, 6 pgs.

"Lenscrafters," http://www.lenscrafters.com, Apr. 24, 1999, pp. 1-8 [last accessed Sep. 26, 2002].

"PlanetRx.com Shows Vision by Adding Contact Lenses and Eye Care Products to Product Mix," PR Newswire, Jan. 19, 2000, 3 pages.

"Single Vision Premium Lenses," Rodenstock GMBH, http://www.rodenstock.ca/index.php/product/item/12, downloaded Mar. 19, 2010, 1 pg.

"The Ultimate in Asphere," product brochure of Pentax Corporation (now division of Hoya Corporation of Japan), believed published before Aug. 10, 2010, 1 pg.

PCT International Search Report for Application No. PCT/US02/21610, Mailed on Jan. 15, 2003, 3 pages.

* cited by examiner

SYSTEM AND METHOD FOR MANUFACTURING A LENS, SUCH AS AN OPHTHALMIC LENS

CROSS-REFERENCE TO RELATED APPLICATION

This application is a divisional of U.S. patent application Ser. No. 11/929,588, filed Oct. 30, 2007, now U.S. Pat. No. 8,002,406 titled "SYSTEM AND METHOD FOR MANUFACTURING A LENS, SUCH AS AN OPTHALMIC LENS, which application in its entirety is incorporated by reference herein.

BACKGROUND

Traditionally, the manufacturing of a lens for use in eyeglasses requires a number of steps, including: (1) choosing a semi-finished lens blank with a finished front surface (base curve) and an unfinished back surface, (2) grinding the back surface with a lathe, such as a toric lathe, that creates a spherical concave or convex surface (such as a cylindrical or spherical surface) on the back surface to place an optical system on the surface used to correct the vision of a user of eyeglasses, and (3) lapping the back surface to smooth the surface to a desired curvature to finish the optical system. Further steps may include polishing and smoothing the lens. Using lathes and laps, the creation of surfaces on lens has often been limited to generally spherical surfaces because the lap can only apply curves to the back surfaces on lenses that maintain the same radius of curvature through the surface.

When creating high power lenses, such as high plus power and/or high prismatic lenses, it is often necessary to create sharp edges at the periphery of the lens (or of the lens blank) during stages of the manufacturing process. For example, in order to create a high power lens, the curve of the front surface and the curve of the back surface of a lens blank can have drastically different radii of curvature. This often leads to the two curves meeting at the periphery of the lens blank and creating a thin, sharp, pointed edge. There are various problems associated with creating sharp points on lens blanks during manufacturing, namely:

The sharp, thin edge often breaks during manufacturing. For example, soft, sponge-like pads are used to polish a lens blank after curves are ground into the lens blank. The pads often get caught in the sharp edge during polishing and the edge breaks off.

The sharp, thin edge often ruins equipment used during manufacturing. For example, polishing pads can tear should they get caught in the sharp edge. This can greatly affect the speed of manufacturing, not to mention the costs associated with manufacturing a lens. Additionally, should a thin edge break off, any subsequent processes may be affected. For example, an edger having a cutting blade tends to slip when a lens to be edged (that is, the periphery is to be removed) is jagged or has pieces broken off.

The sharp, thin edge does not allow for automated manufacturing. Because the sharp edges are thin and require care when handling, inspectors and other manufacturing personnel are required to regulate the stages of the manufacturing process.

The sharp, thin edge can lead to improper coating of a lens. For example, when a coating (e.g., an anti-reflective coating) is being applied to a front surface of a lens blank having a thin edge, the application of the coating will often wrap around the thin edge and be applied to the back surface, which is undesirable and can ruin a lens.

Attempts to correct these problems have additional disadvantages. Typically, manufacturers add unwanted and/or unneeded thickness to the entire lens to offset the thinning or sharpening at the periphery where a front curve and a back curve meet. However, adding thickness leads to lenses that are bulky and inconvenient to a user wearing eyeglasses with such lenses. Also, the additional thickness in the center portion increases the magnification, appearance, and weight of the lens, causing the wearer of the lens (i.e., in eyeglasses) cosmetic and physical discomfort.

The need exists for a system that overcomes the above problems, as well as one that provides additional benefits. Overall, the examples herein of some prior or related systems and their associated limitations are intended to be illustrative and not exclusive. Other limitations of existing or prior systems will become apparent to those of skill in the art upon reading the following Detailed Description.

DETAILED DESCRIPTION

Figure 1A:
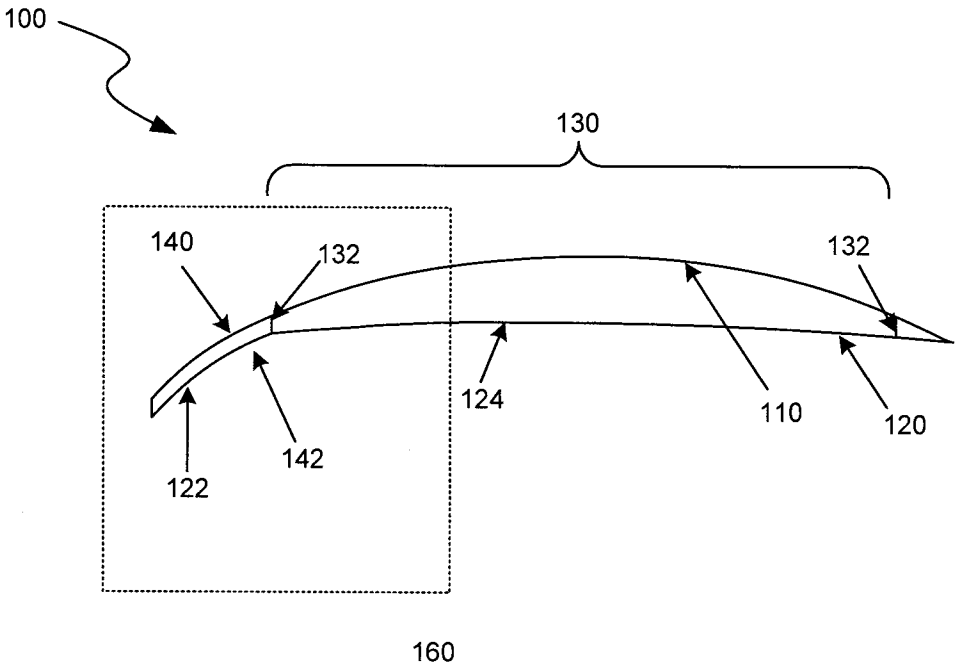
FIG. 1A is a diagram illustrating a cross-sectional view of a lens blank that includes an asymmetrically curved back surface at the periphery of the lens.

A system and method for modifying a periphery of a lens blank during manufacturing of the lens is described. In some examples, the system creates a back surface on a lens blank having a specified radius of curvature at the part of the lens blank containing a prescription, and a different radius of curvature at the periphery of the lens blank. The system may produce curves on lens surfaces that non-spherically change in curvature from the center of the lens to the periphery. For example, the system may create conic-based surfaces, such as hyperbolic surfaces, that are substantially spherical, cylindrical, or spherocylindrical throughout the prescription portion of the lens and substantially aspherical past the prescription portion of the lens (that is, the portion to be ultimately removed when fitting the lens to an eyeglass frame).

In some cases, the system may employ digital surfacing in creating the curves on the lens surfaces. Digital surfacing, and other soft tool based surfacing, is a relatively new manufacturing technique in the industry that allows manufacturers to create a continuously changing surface on lenses, unlike previous lathing and lapping techniques described herein. For example, using digital surfacing, a diamond or other type of cutter produces a back surface of a lens according to a specified depth, at a precision of one tenth of a micron or less. Thus, digital surfacing, in some cases, enables manufacturers to create non-spherical surfaces on lenses, including on portions of lens blanks that will later be discarded.

In some cases, the manufacturing of a lens using the system described herein includes selecting a lens blank, creating a curve on a back surface of the lens blank that contains a section for a prescription to be applied to the lens and a section that prevents a sharp edge from forming at the periphery, and removing the section that prevents the sharp edge from forming at the periphery. Thus, the system manufactures a lens having a desired prescription and specific size to fit eyeglass frames without creating sharp edges during the manufacturing process that can lead to damage to the lens, and/or to the manufacturing equipment.

In some cases, the curve of the back surface at the periphery of the lens blank follows the curve of a front surface at the periphery of the lens blank. This maintains the thickness of the lens throughout the periphery and prevents sharp, thin edges from forming during the initial application of a prescription to lens surfaces.

Various examples of the technology will now be described. The following description provides specific details for a thorough understanding and enabling description of these examples. One skilled in the art will understand, however, that the technology may be practiced without many of these details. Additionally, some well-known structures or functions may not be shown or described in detail, so as to avoid unnecessarily obscuring the relevant description of the various examples.

The terminology used in the description presented below is intended to be interpreted in its broadest reasonable manner, even though it is being used in conjunction with a detailed description of certain specific examples of the technology. Certain terms may even be emphasized below; however, any terminology intended to be interpreted in any restricted manner will be overtly and specifically defined as such in this Detailed Description section.

As described herein, aspects of the system and method enable eyeglass manufacturers to create high plus power and high prismatic power lenses without creating thin, sharp edges on lens blanks used during the manufacturing process. FIG. 1 shows a cross-sectional view of a high plus power lens blank 100 used in eyeglasses having an aspherically curved back surface at the periphery formed in accordance with the methods disclosed herein. Lens blank 100 leads to a plus lens, which is often used to correct farsightedness in patients. Lens blank 100 has a front surface 110 and a back surface 120. Lens blank 100 may lead to a spherical lens, a cylindrical lens, or a spherocylindrical lens. The front surface 110 may be a spherical or aspherical curve, depending on the type of lens needed or type of corrections required for the eyeglass wearer. The back surface 120 is curved to meet the needs of a patient's prescription. At a center portion 130 of the lens blank, a section of the curve 124 on the back surface is spherically curved based on a prescribed correction.

In addition, the lens blank 100 includes a modified peripheral portion 140. The modified peripheral portion 140 begins when the curve on the back surface changes 142 from the prescribed radius of curvature 124 to a different radius of curvature 122. In some cases, the different radius of curvature will be similar to the radius of curvature of the front surface at the periphery. Additionally, the curve of the back surface 120 may change in curvature at a point where the lens blank 100 will contain an edge 132 in the finished lens product.

Changing the curvature of the back surface of the lens creates thickness to the peripheral portion 140 that would not otherwise be there during typical manufacturing. This thickness may be adjusted by adjusting the applied curve. In some cases, a thickness of 1.0 mm or more is advantageous to prevent the lens from breaking or harming equipment. However, one of ordinary skill in the art will appreciate that the system may employ thickened peripheral portions that are more or less than 1.0 mm in order to achieve similar results. For example, the type of equipment used, the type and number of coatings applied to a lens, the type of material of the lens blank, and other factors may contribute to choosing a proper thickness for the peripheral portion of the lens blank.

Figure 1B:
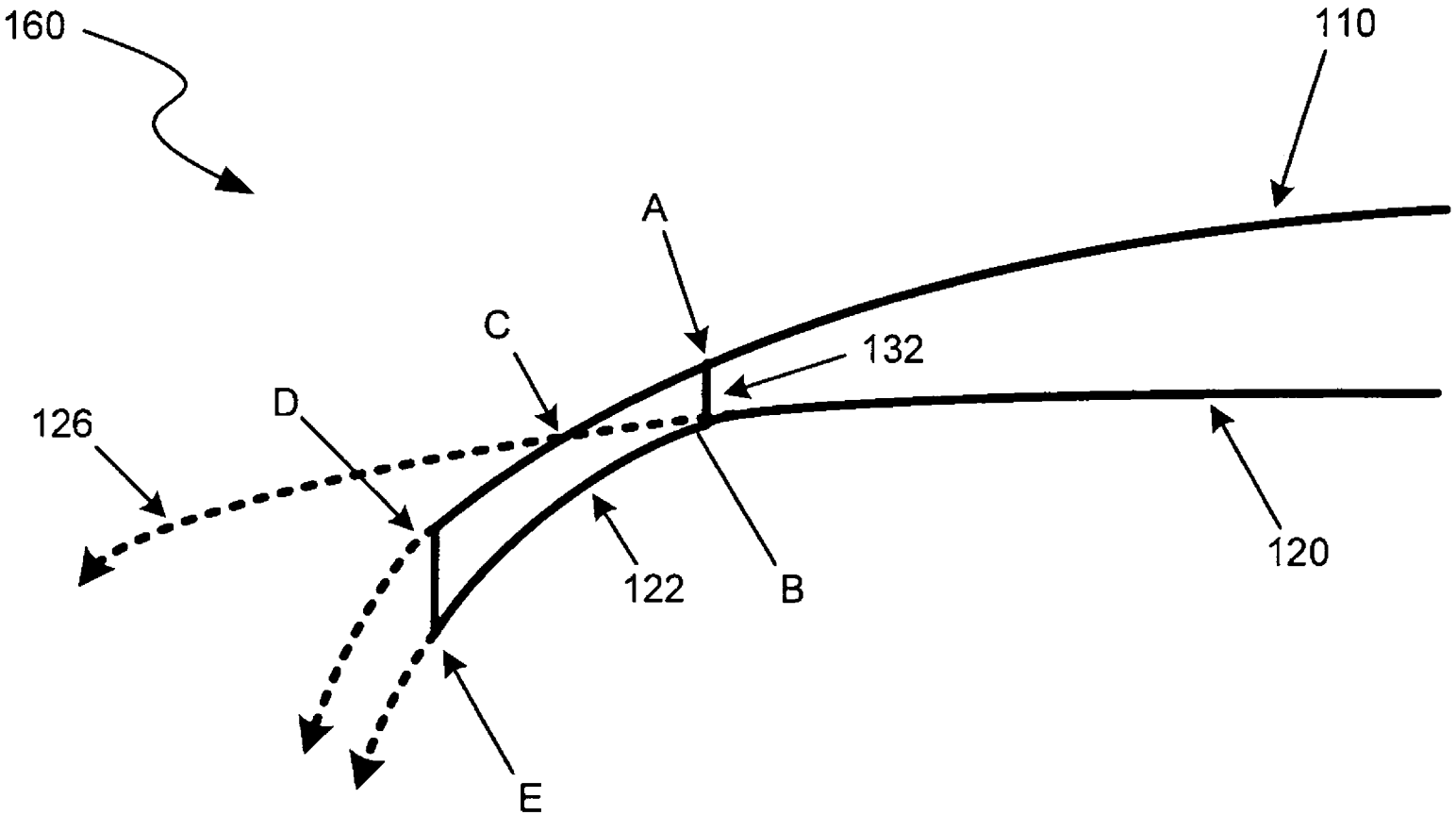
FIG. 1B is a diagram illustrating an exploded view of a periphery of a lens blank.

Thus, the system provides a lens blank having a peripheral portion of a desired thickness and/or roundness to facilitate the manufacturing of a lens. FIG. 1B is a diagram illustrating an exploded view of the periphery 160 of a lens blank shown in FIG. 1A. The periphery 160 is formed by the curves of the front surface 110 and the back surface 120. In typical manufacturing, a lathe grinds the back surface 120 at the periphery by following the curve 126 of the back surface from point B to point C. However, the system described herein adjusts the curvature of the periphery starting at point B, following a new curve 122 from point B to point E.

The curvature adjustment may be gradual and abrupt, or may follow a smooth, rapid curve. Although the adjustment, or change in curvature, is shown as beginning at point B, in some cases the system may create a surface that begins to change curvature before point B. That is, the curvature may change or begin to change close to or within a prescription section of the back surface. As is described herein, the choice of curvatures, adjustments, and so on may be guided by prescriptions applied to lenses, manufacturing needs, cosmetic needs, and so on.

Typical systems create a peripheral portion ABC terminating at a sharp edge, while the system described herein creates a peripheral portion ABED that is rounder and thicker than a peripheral portion created by conventional methods. Additionally, the peripheral portion is not used in the final lens product, because the lens blank will ultimately be cut at edge 132 to create the final lens size used in eyeglass frames. Thus, modifying the peripheral portion enables the system to create a lens blank that is advantageous for use in various stages of the manufacturing process without affecting the final lens product.

Although the method of modifying lens blanks has been described herein with respect to convex or plus lenses, some or all aspects of the system may be applied to concave or minus lenses. During the manufacturing of minus lenses, the peripheral portions of a lens blank are generally thicker than the center section containing the minus prescription. The thicker peripheral portion can lead to problems during manufacturing, such as during surfacing of the lens blank, polishing of the lens blank, edging the lens blank, and so on.

Figure 1C:
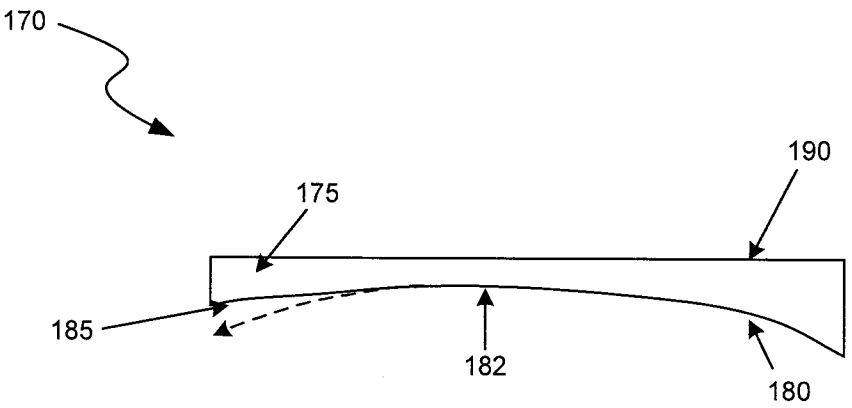
FIG. 1C is a diagram illustrating a cross-sectional view of a minus lens blank.

In similar fashion to plus lenses, the system described herein can be employed to modify the peripheral portion of a minus lens blank in order to create a lens blank that enables a more precise and effective manufacturing process of a lens. For example, the system may remove some of the peripheral portion of a lens blank during an initial surfacing application to thin the periphery of the lens blank before further processing steps. Referring to FIG. 1C, an example minus lens blank 170 having a thinned peripheral portion is shown. The lens blank 170 includes a front surface 190 and a back surface 180 that combine to establish a minus prescription on the lens blank 170. The back surface 180 includes a center section 182 having a curvature related to the prescription and an outer section 184 having a curvature related to thinning a peripheral portion 175 of the lens blank. In some cases, the radius of curvature of the outer section 184 is greater than the radius of curvature of the center section 182. In some cases, the curve of the outer section 184 is similar to that of the front surface 190. Thus, the system can provide a lens bank having a reduced peripheral portion 175 that facilitates improved or less destructive edging, glazing, and/or finishing of the lens blank to create a finished lens, among other benefits.

Furthermore, the system may be employed when manufacturing other lenses. For example, the system may be applied to the front surfaces of lens blanks (such as for lenses that are aspheric and/or progressive due to changes in the front surface of the lens) and to combination lenses, such as spherocylindrical lenses. Examples of other lens that may be manufactured by the system include biconvex lenses, biconcave lenses, plano-concave lenses, plano-convex lenses, meniscus lenses, concave-convex lenses, cylindrical lenses, and so on.

Figure 2:
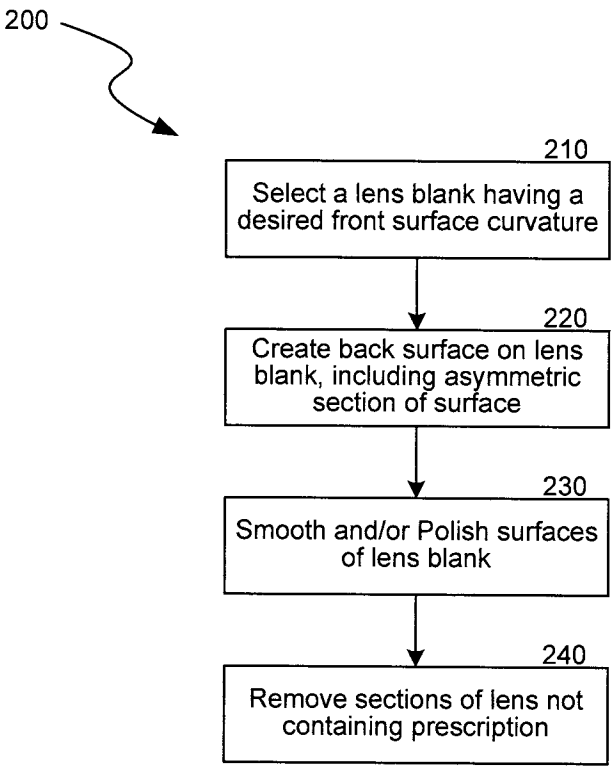
FIG. 2 is a flow diagram illustrating a routine for manufacturing a lens.

As described herein, in some examples the system modifies a peripheral portion of a lens blank during the manufacturing of a lens. FIG. 2 is a flow diagram illustrating a routine 200 for manufacturing a lens using the modified lens blanks described herein. In step 210, the system selects a lens blank having a desired front surface curvature. That is, the system chooses a lens blank to start the process. In some cases, the lens blank has a front surface associated with the prescription to be applied to the lens for the patient and a back surface that requires a curve to be applied. In step 220, the system creates a back surface on the lens blank, including at the peripheral portion. For example, the system employs the digital surfacing techniques described herein to apply a curve to the back surface having two distinct curvatures: (1) a first curvature at the prescription portion of the lens blank (the portion that will ultimately be the lens in the eyeglass frame) and (2) a second curvature at the peripheral portion of the lens blank (the portion that will be later removed from the lens blank in a final edging or finishing process in creating the lens).

In step 230, the system performs additional manufacturing processes, including smoothing and/or polishing the lens blank. The thickened peripheral portion facilitates these processes because the thickened portion does not have sharp edges that can tear or harm the equipment used in manufacturing, and prevents the peripheral portion from breaking off during manufacturing. Additionally, other processes may be performed that assist in providing finished surfaces on the lens blank, such as further smoothing, coating, and other treatment processes.

In step 240, the system removes the peripheral portion of the lens blank to cut and size the lens for use in eyeglass frames. For example, the system may perform edging, glazing, and/or finishing to the lens blank to provide a suitable lens for eyeglass frames. This may include cutting the lens blank to a shape suitable for a target eyeglass frame and/or mounting the lens into the eyeglass frame. Thus, the thickened peripheral portion is now discarded, having served its purpose in facilitating the polishing and smoothing stages of the manufacturing process by preventing harm to the manufacturing equipment or to the lens.

Figures 3A, 3B, 3C:
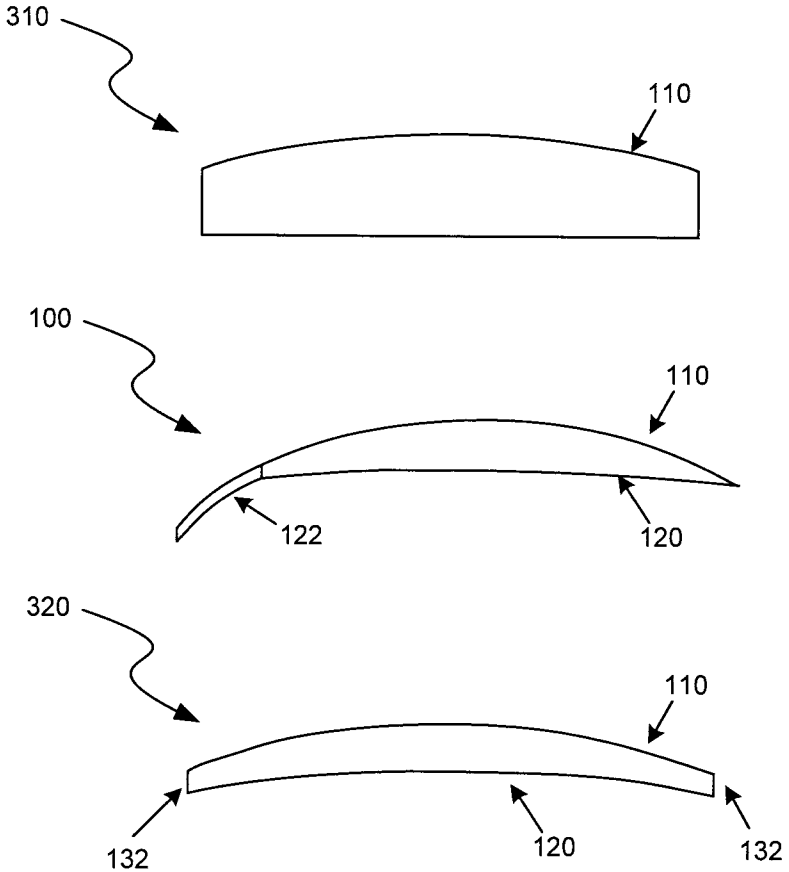
FIGS. 3A to 3C are diagrams illustrating a lens at various stages of manufacturing.

As described herein, in some examples the system creates a lens blank having a thickened peripheral portion to protect the lens and equipment from harm during the manufacturing. As described herein, in some cases the system forms the peripheral portion when applying a prescription to the lens, such as when applying a curve to the back surface of the lens. FIGS. 3A to 3C are diagrams illustrating a lens at various stages of manufacturing.

Referring to FIG. 3A, a lens blank 310 used as an initial form in creating a lens is shown. The lens blank 310 includes a front surface 110 having a radius of curvature representative of or associated with a prescription to be applied to the lens blank when manufacturing the lens. FIG. 3B represents a lens blank after a back surface 120 has been applied to the lens, such as a back surface including a radius of curvature 122 at a periphery of the lens that is different from the radius of curvature based on the prescription. For example, the radius of curvature may be similar to the radius of curvature of the front surface, or may be any radius of curvature that prevents the curve of the back surface from intersecting the curve of the front surface within the periphery. FIG. 3C represents a manufactured lens 320. The lens 320 contains the front surface 110, the back surface 120, and an outer edge 132 that is formed after the periphery has been removed. Thus, FIGS. 3A-3C represent a lens in various stages of manufacture, from a lens blank 310 used as a template for a prescription lens to a lens blank containing a thickened or rounded peripheral portions as described herein, to a finished lens 320 that can be fitted into a eyeglass frame.

Figure 4:
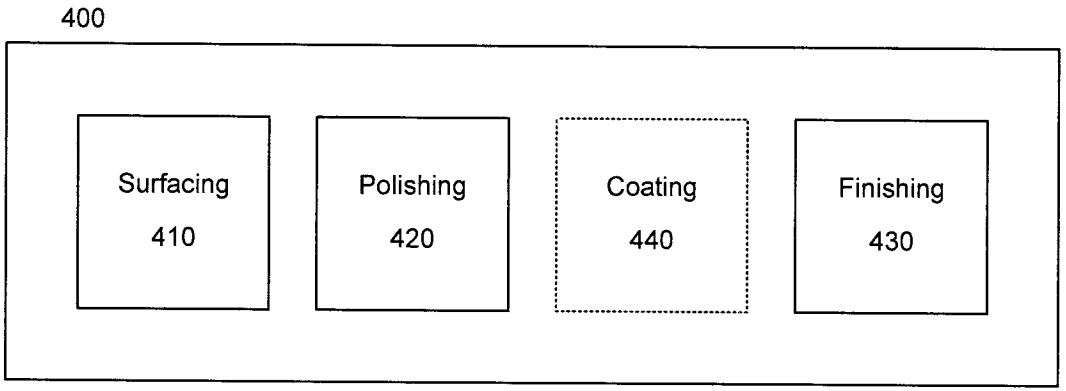
FIG. 4 is a block diagram illustrating a manufacturing system used to manufacture lenses and/or optical devices.

As discussed above, the lens blanks 310 may be utilized within systems used to manufacture lenses to be inserted into eyeglass frames, sunglass frames, and other corrective and/or functional wearable optical devices. Referring to FIG. 4, a block diagram illustrating a manufacturing system 400 used to manufacture lenses and/or optical devices is shown. The system 400 includes a surfacing component 410 that applies a surface to a front surface of a lens blank, to a back surface of a lens blank, or to both surfaces, in order to apply a prescription to the lens blank. The surfacing component 410 may apply surfaces that vary in curvature, such as those described herein. The surfacing component 410 may employ lathes, laps, and/or digital surfacing components when applying surfaces to lens blanks. For example, the surfacing component 410 may include a diamond cutter that applies a free-form surface to the back and/or front surfaces of the lens to attain a desired prescription within the lens blank.

In some cases, the surfacing component 410 (and other components described herein, including digital surfacing components) includes software running on a computing system, such as computer-executable code or instructions, that define, derive, and/or create the surfaces to be applied to the lens blank in response to received parameters, such as parameters related to a prescription for the lens blank, parameters related to the desired thickening or thinning of the periphery of the lens blank, and so on.

Furthermore, the manufacturing system 400 includes a polishing component 420 that refines the applied surfaces. For example, the system may apply sponge-like pads to the front and back surfaces of the lens blank to further smooth and refine the applied surfaces. The system 400 also includes a finishing component 430 that receives a polished lens blank and creates a finished lens. The finishing component may include components that edge, glaze, or otherwise finish a lens for insertion into frames, such as eyeglass frames. In addition, the system 400 may optionally include a coating component 440 used to coat the surfaces of the lens blank. For example, the coating component 440 may apply an anti-reflective coating, a protective coating (e.g., a UV protective coating or a scratch resistant coating), and so on. Of course, the system 400 may include other components used when manufacturing a lens.

In addition to the above prescription lens examples, the system may be used when manufacturing non-prescription lenses. For example, the system may facilitate the application of protective and other coatings to sunglass lenses during the manufacturing of the lenses. Furthermore, the system may be used when creating a lens for other uses and/or purposes. Some examples include: lenses used in telescopes, microscopes and other compound optical systems and devices, electronics (such as CD players, DVD players, and so on), optical communication systems and devices, or other systems and devices that employ or rely on plus or minus lenses.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the system is not intended to be exhaustive or to limit the system to the precise form disclosed above. While specific embodiments of, and examples for, the system are described above for illustrative purposes, various equivalent modifications are possible within the scope of the system, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times. Further any specific numbers noted herein are only examples: alternative implementations may employ differing values or ranges.

The teachings of the system provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the system can be modified, if necessary, to employ the systems, functions, and concepts of the various references described above to provide yet further embodiments of the system.

These and other changes can be made to the system in light of the above Detailed Description. While the above description describes certain embodiments of the system, and describes the best mode contemplated, no matter how detailed the above appears in text, the system can be practiced in many ways. Details of the system may vary considerably in its implementation details, while still being encompassed by the system disclosed herein. As noted above, particular terminology used when describing certain features or aspects of the system should not be taken to imply that the terminology is being redefined herein to be restricted to any specific characteristics, features, or aspects of the system with which that terminology is associated. In general, the terms used in the following claims should not be construed to limit the system to the specific embodiments disclosed in the specification, unless the above Detailed Description section explicitly defines such terms. Accordingly, the actual scope of the system encompasses not only the disclosed embodiments, but also all equivalent ways of practicing or implementing the system under the claims.

While certain aspects of the system are presented below in certain claim forms, the inventors contemplate the various aspects of the system in any number of claim forms. For example, while only one aspect of the system is recited as a system claim, other aspects may likewise be embodied as a means-plus-function claim under 35 U.S.0 sec. 112, sixth paragraph, or in other forms, such as being embodied in a method of manufacturing (Any claims intended to be treated under 35 U.S.C. §112, ¶6 will begin with the words "means for".) Accordingly, the inventors reserve the right to add additional claims after filing the application to pursue such additional claim forms for other aspects of the system.

We claim:

1. A system for manufacturing a positive power lens for use in prescription eyeglasses, comprising:

a surfacing component configured to apply a new back surface to a lens blank, wherein the lens blank has a front surface and a back surface, and the front surface has a front surface radius of curvature associated with a prescription for a lens having positive power; and a processor, communicatively coupled to the surfacing component, and configured to:

determine when a back surface radius of curvature is applied to the back surface of the lens blank, such that the back surface radius of curvature together with the front surface radius of curvature provide the prescription, whether a first thickness of a peripheral section of the lens blank will be less than a predetermined thickness threshold; and if the determination is that the first thickness of the peripheral section of the lens blank with the back surface radius of curvature will be less than the predetermined thickness threshold, then directing the surfacing component to remove less than the lens blank material needed to create the back surface radius of curvature from the peripheral section of the back surface, wherein a resulting peripheral section has a second thickness equal to or greater than the predetermined thickness threshold, and a resulting optical power of the resulting peripheral section differs from the prescription.

2. The system of claim 1, wherein the surfacing component uses digital surfacing techniques.

3. The system of claim 1, further comprising a finishing component configured to remove at least a portion of the peripheral section of the lens blank to create the lens.

4. The system of claim 3, further comprising:

a coating component, wherein the coating component applies a coating to the front surface of the lens blank or to the new back surface of the lens blank before the finishing component removes the portion of the peripheral section.

5. The system of claim 1, wherein the lens blank has an aspherical curvature on the front surface.

6. The system of claim 1, wherein the front surface radius of curvature is substantially similar to a peripheral back surface radius of curvature of the resulting peripheral section.

7. The system of claim 1, wherein a peripheral back surface radius of curvature of the resulting peripheral section is smaller than the back surface radius of curvature.

8. A system for manufacturing a negative power lens for use in prescription eyeglasses, comprising:

a surfacing component configured to apply a new back surface to a lens blank, wherein the lens blank has a front surface and a back surface, and the front surface has a front surface radius of curvature associated with a prescription for a lens having negative power; and a processor, communicatively coupled to the surfacing component, and configured to:

determine when a back surface radius of curvature is applied to the back surface of the lens blank, such that the back surface radius of curvature together with the front surface radius of curvature provide the prescription, whether a first thickness of a edge portion of the lens blank will be greater than a predetermined thickness threshold; and if the determination is that the first thickness of the edge portion of the lens blank with the back surface radius of curvature will be greater than the predetermined thickness threshold, then directing the surfacing component to remove more than the lens blank material needed to create the back surface radius of curvature from the edge portion of the back surface, wherein a resulting edge portion has a second thickness equal to or less than the predetermined thickness threshold, and a resulting optical power of the resulting edge portion differs from the prescription.

9. The system of claim 8, wherein the surfacing component uses digital surfacing techniques.

10. The system of claim 8, further comprising a finishing component configured to remove at least a portion of the edge section of the lens blank to create the lens.

11. The system of claim 10, further comprising:

a coating component, wherein the coating component applies a coating to the front surface of the lens blank or to the new back surface of the lens blank before the finishing component removes the portion of the edge section.

12. The system of claim 8, wherein the lens blank has an aspherical curvature on the front surface.

13. The system of claim 8, wherein the front surface radius of curvature is substantially similar to an edge back surface radius of curvature of the resulting edge section.

14. The system of claim 8, wherein an edge back surface radius of curvature of the resulting edge section is greater than the back surface radius of curvature.

15. A system for manufacturing a positive power lens for use in prescription eyeglasses, comprising:

means for surfacing configured to apply a new back surface to a lens blank, wherein the lens blank has a front surface and a back surface, and the front surface has a front surface radius of curvature associated with a prescription for a lens having positive power; and a processor, communicatively coupled to the means for surfacing, and configured to:

determine when a back surface radius of curvature is applied to the back surface of the lens blank, such that the back surface radius of curvature together with the front surface radius of curvature provide the prescription, whether a first thickness of a peripheral section of the lens blank will be less than a predetermined thickness threshold; and if the determination is that the first thickness of the peripheral section of the lens blank with the back surface radius of curvature will be less than the predetermined thickness threshold, then directing the means for surfacing to remove less than the lens blank material needed to create the back surface radius of curvature from the peripheral section of the back surface, wherein a resulting peripheral section has a second thickness equal to or greater than the predetermined thickness threshold, and a resulting optical power of the resulting peripheral section differs from the prescription.

16. The system of claim 15, wherein the means for surfacing uses digital surfacing techniques.

17. The system of claim 15, further comprising a finishing component configured to remove at least a portion of the peripheral section of the lens blank to create the lens.

18. The system of claim 17, further comprising:

a coating component, wherein the coating component applies a coating to the front surface of the lens blank or to the new back surface of the lens blank before the finishing component removes the portion of the peripheral section.

19. The system of claim 15, wherein the lens blank has an aspherical curvature on the front surface.

20. The system of claim 15, wherein the front surface radius of curvature is substantially similar to a peripheral back surface radius of curvature of the resulting peripheral section.

21. The system of claim 15, wherein a peripheral back surface radius of curvature of the resulting peripheral section is smaller than the back surface radius of curvature.

* * * * *

UNITED STATES PATENT AND TRADEMARK OFFICE

CERTIFICATE OF CORRECTION

PATENT NO. : 8,641,192 B2
APPLICATION NO. : 13/212079
DATED : February 4, 2014
INVENTOR(S) : Stan Arrigotti et al.

It is certified that error appears in the above-identified patent and that said Letters Patent is hereby corrected as shown below:

On the Title Page, Item (74), in column 2, in "Attorney, Agent, or Firm", line 1, delete "Perkin Coie LLP" and insert -- Perkins Coie LLP --, therefor.

In the Specification

In column 8, line 3, delete "U.S.0" and insert -- U.S.C. --, therefor.

Signed and Sealed this
Twentieth Day of May, 2014

Michelle K. Lee

Michelle K. Lee
*Deputy Director of the United States Patent and Trademark Office*